US008702540B2

(12) United States Patent
Menchio

(10) Patent No.: US 8,702,540 B2
(45) **Date of Patent: *Apr. 22, 2014**

(54) INTRA-DIGITAL ORTHOSIS FOR USE IN SHOOTING A BALL SUCH AS A BASKETBALL

(76) Inventor: Richard W. Menchio, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/471,155

(22) Filed: May 14, 2012

(65) Prior Publication Data

US 2014/0004980 A1 Jan. 2, 2014

Related U.S. Application Data

(63) Continuation of application No. 11/811,571, filed on Jun. 11, 2007, now Pat. No. 8,177,667.

(51) Int. Cl.
*A63B 69/00* (2006.01)

(52) U.S. Cl.
USPC ..... 473/450; 473/22; 473/447

(58) Field of Classification Search
CPC ..... A63B 2243/0037; A63B 69/0059; A63B 71/14; A63B 71/141; A63B 63/083; A63B 21/1438
USPC ..... 473/422, 450, 458, 464, 59, 615, 212, 473/433, 447, 205; 434/248; 482/48
See application file for complete search history.

(56) References Cited

U.S. PATENT DOCUMENTS

| | | | | |
|---|---|---|---|---|
| 897,471 | A * | 9/1908 | Loyola | 482/48 |
| 2,271,164 | A * | 1/1942 | Sullivan | 482/47 |
| 2,994,533 | A * | 8/1961 | Pupilla, Jr. | 473/62 |
| 3,103,213 | A * | 9/1963 | Robinson | 473/205 |
| 3,189,025 | A * | 6/1965 | Yaklin | 601/40 |
| 3,612,521 | A * | 10/1971 | Wendeborn | 482/48 |
| 4,751,747 | A * | 6/1988 | Banks et al. | 2/21 |
| 5,062,625 | A * | 11/1991 | Vonk | 482/48 |
| 6,817,967 | B1 * | 11/2004 | Ott et al. | 482/48 |

* cited by examiner

*Primary Examiner* — Mitra Aryanpour
(74) *Attorney, Agent, or Firm* — Morland C. Fischer

(57) ABSTRACT

An intra-digital orthosis for use in shooting a ball such as a basketball comprising: index and ring finger receptacles each having an aperture; a middle finger backstop; and first and second shafts joining the index and ring finger receptacles to the middle finger backstop. The orthosis preferably spaces apart and/or encourages flexion of the distal phalanges of at least a user's index and ring fingers and/or facilitates an arch angle between those fingers and the user's middle finger that approximates the curvature of the ball being thrown so as to facilitate and enhance the user's ability to position the hand when shooting the ball.

5 Claims, 5 Drawing Sheets

INTRA-DIGITAL ORTHOSIS FOR USE IN SHOOTING A BALL SUCH AS A BASKETBALL

CROSS REFERENCE TO RELATED PATENT APPLICATIONS

This application is a Continuation of patent application Ser. No. 11/811,571 filed Jun. 11, 2007, now U.S. Pat. No. 8,177,667.

FIELD OF THE INVENTION

The present invention relates to orthoses for improving performance in sports, and more particularly, to an intra-digital orthosis for use in shooting a ball such as a basketball.

BACKGROUND OF THE INVENTION

Various devices have been designed in an effort to improve style, accuracy, and efficiency in throwing balls such as basketballs. However, a need remains for a device that can space apart and/or encourage flexion of the distal phalanges of at least a user's index and ring fingers and/or facilitate an arch angle between those fingers and the user's middle finger that approximates the curvature of a basketball so as to facilitate arm enhance the user's ability to position the hand when shooting a basketball.

SUMMARY OF THE INVENTION

An intra-digital orthosis for use in shooting a ball such as a basketball according to an embodiment of the present invention comprises: index and ring finger receptacles each having an aperture; a middle finger backstop; and first and second shafts joining the index and ring finger receptacles to the middle finger backstop. The orthosis preferably spaces apart and/or encourages flexion of the distal phalanges of at least a user's index and ring fingers and/or facilitates an arch angle between those fingers and the user's middle finger that approximates the curvature of the ball being thrown so as to facilitate and enhance the user's ability to position the hand when shooting the ball.

DETAILED DESCRIPTION OF A PREFERRED EMBODIMENT

Figure 1:
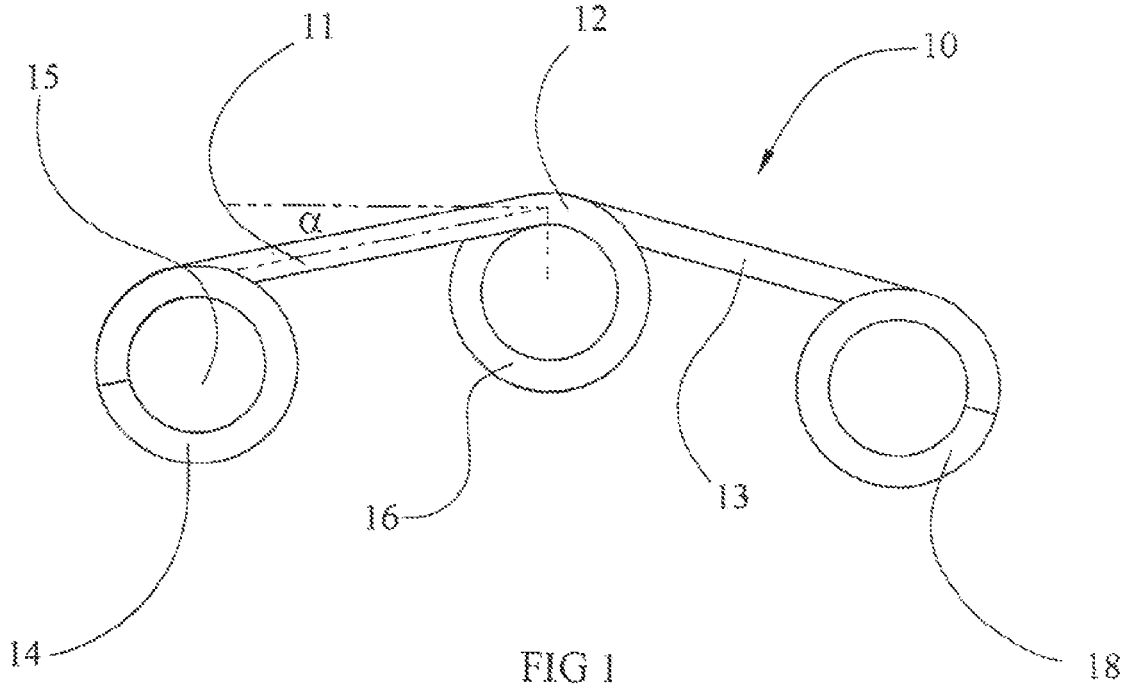
FIG. 1 is a rear view of a first embodiment of an intra-digital orthosis for use in shooting a ball such as a basketball according to the present invention.

All of the figures are directed to embodiments of the present invention that are particularly adapted for use in shooting a basketball. The first embodiment of the orthosis 10, depicted in FIGS. 1 and 2, comprises an index finger receptacle 14, a middle finger receptacle 16, and a ring finger receptacle 18, each having apertures 15, and joined by a first shaft 11 and a second shaft 13. This uncomplicated embodiment of the invention can readily be formed by cutting a length of (e.g., 12-gauge) insulated copper wire 12 and bending it to form the receptacles and an arch angle $\alpha$ and a spread angle $\beta$. The arch angle $\alpha$ is provided to ensure the middle fingertip of the user's hand is arched above the index and ring fingers so as to approximate the curvature of a basketball, and preferably may be about ten to forty degrees. The spread angle $\beta$ is provided to accommodate the typical differential in the length of the middle finger as compared to the ring and index fingers, and preferably may be about five to thirty degrees. (The arch and spread angles may preferably be implemented similarly for the remaining embodiments, and therefore will not be mentioned with respect to those embodiments). The wire 12 is preferably chosen to prevent any substantial extension or compression along its length under manual force that could be exerted by a user when the orthosis 10 is being worn, is preferably rigid enough to permit only a minor degree of flexing under forces encountered during ordinary use, and is preferably coated or sheathed with a polymer that provides a tactile grip. The wire 12 (or other material constituting the finger receptacles in other embodiments) is also preferably chosen to have a thickness adequate to require the user to flex the restrained fingertips in order to make contact with the basketball (but not too thick to hinder good contact), e.g., 4 mm (i.e., 0.16 inches), and may be particularly chosen for a given user's finger dimensions.

Figure 2:
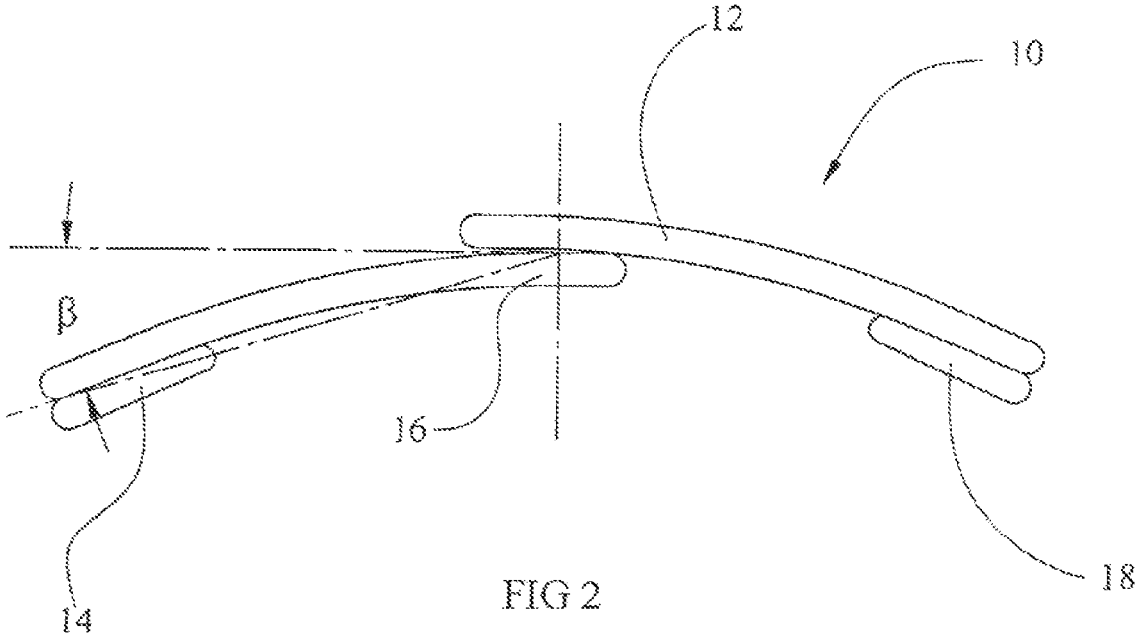
FIG. 2 is a top view of the embodiment depicted in FIG. 1.

It may be appreciated that because of the spread angle described above to which the wire 12 of the orthosis 10 is bent, none of the longitudinal axes through respective ones of the index finger, ring ringer and middle finger receptacles 14, 16 and 18 are aligned parallel to one another (best illustrated in FIG. 2).

Figure 3:
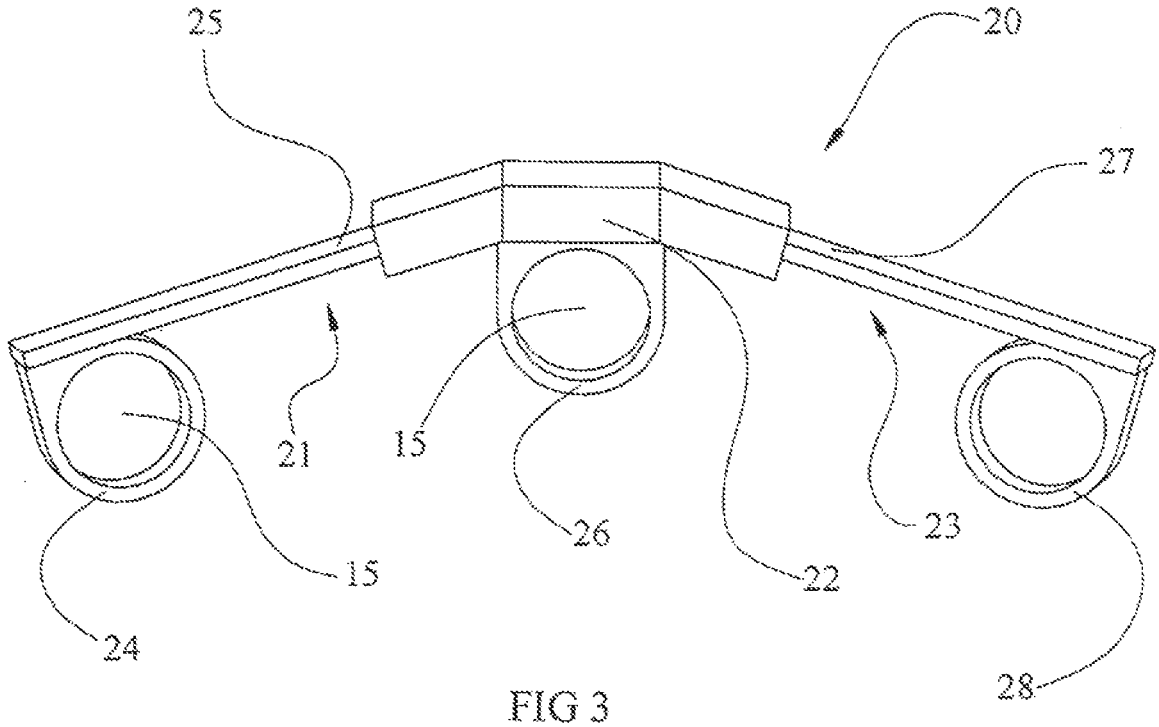
FIG. 3 is a top rear perspective view of a second embodiment of an intra-digital orthosis for use in shooting a ball such as a basketball according to the present invention.
Figure 3A:
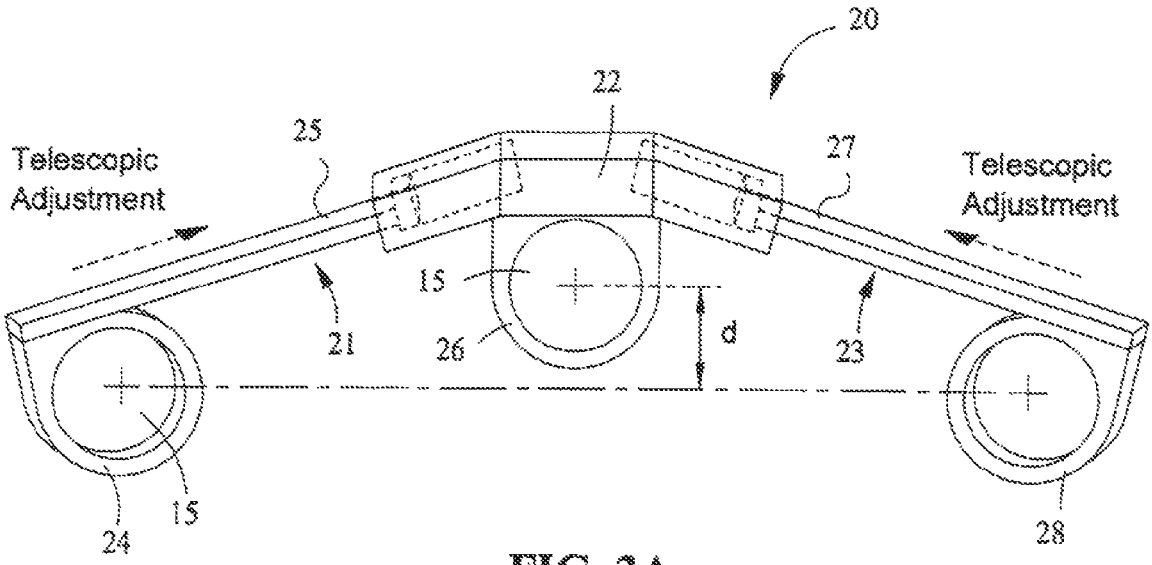
FIG. 3A shows the intra-digital orthosis of FIG. 3 having telescopically-adjustable first and second shafts relative to one another.

The second embodiment of the orthosis 20, depicted in FIG. 3, similarly comprises an index finger receptacle 24, a middle finger receptacle 26, and a ring finger receptacle 28, each having apertures 15, and joined by a first shaft 21 and a second shaft 23. In this embodiment, however, the spacing of the index finger receptacle 24 and the ring finger receptacle 28 from the middle finger receptacle 26 can be adjusted: Specifically, the elongate member 25 on which index finger receptacle 24 is formed telescopes within an internal cavity (best shown in FIG. 3A) formed in the left end of central member 22, and is adapted to be secured therein by the user through a tight interference fit, mating ribs, mating threads, or other suitable means (not shown). Likewise, the elongate member 27 on which ring finger receptacle 28 is formed telescopes within an internal cavity (not shown) formed in the right end of central member 22, and is adapted to be secured therein by the user. The spacing should be selected so that the user's fingers are under a moderate amount of tension, but not enough to cause discomfort.

Figure 4:
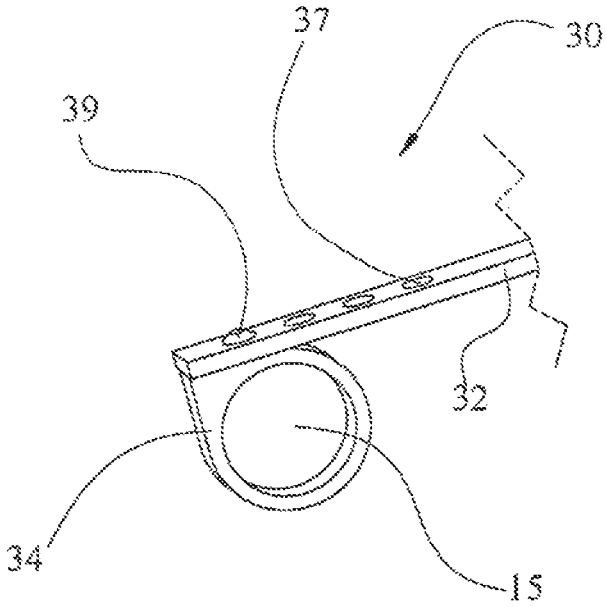
FIG. 4 is a partial top rear perspective rear view of a third embodiment of an intra-digital orthosis for use in shooting a ball such as a basketball according to the present invention.
Figure 4A:
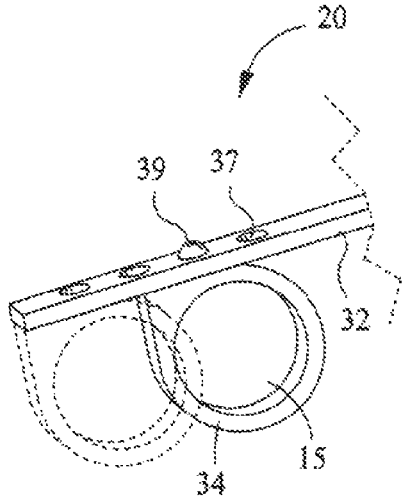
FIG. 4A illustrates the removable and adjustable nature of a finger receptacle shown for the intra-digital orthosis of FIG. 4.

Alternately, as shown in FIG. 4, adjustability to the spacing of the index and ring finger receptacles from the middle finger receptacle can instead be provided in an orthosis 30 having a single integral bridge 32 formed with a series of retaining holes 37 on its left and right ends (only the left end being sown in FIG. 4), into which the user can lodge a protruding clip 39 (preferably metallic, and formed, e.g., like the end of a Canoe® clip, various similar snap-lock clips used to secure automotive panels and carpeting, or the like) formed on a removable index finger receptacle 34 and removable ring finger receptacle (not shown). To remove an index or ring finger receptacle for placement at another retaining hole 37 in the manner depicted in FIG. 4A, the user squeezes the protruding clip 39, allowing the receptacle to be removed. (Alternately, instead of protruding clips 39, various other means of securing such removable finger receptacles could be employed, e.g., mating threads, the receptacle attachment means disclosed in U.S. Pat. No. 5,136,911—the disclosure of which is hereby incorporated by reference, etc.). It is also noted that multiple finger receptacles redundant except for different sizing could be provided to accommodate users having different finger thicknesses (in which case the middle finger receptacle, if any, may also preferably be removable). The apertures 15 (in any embodiment) are preferably selected to be small enough to ensure that during use the receptacles remain adequately snug against the user's intermediate phalanges to retain the orthosis in place, but not too small to cause discomfort.

Figure 5:
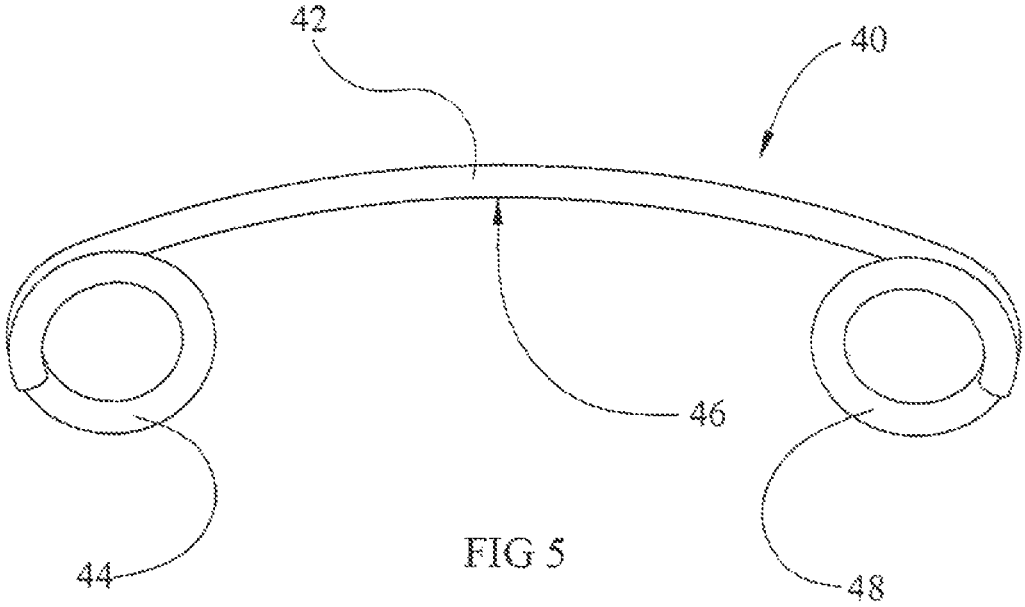
FIG. 5 is a top rear perspective view of a fourth embodiment of an intra-digital orthosis for use in shooting a ball such as a basketball according to the present invention.

As shown in FIG. 5, another uncomplicated embodiment of orthosis 40 dispenses with the middle finger receptacle, providing instead a single integral bridge 42 that has only a middle finger backstop 46 between the index finger receptacle 44 and ring finger receptacle 48. (It is noted that a middle finger backstop is of course inherently a part of the middle finger receptacles of the previous embodiments).

Figure 6:
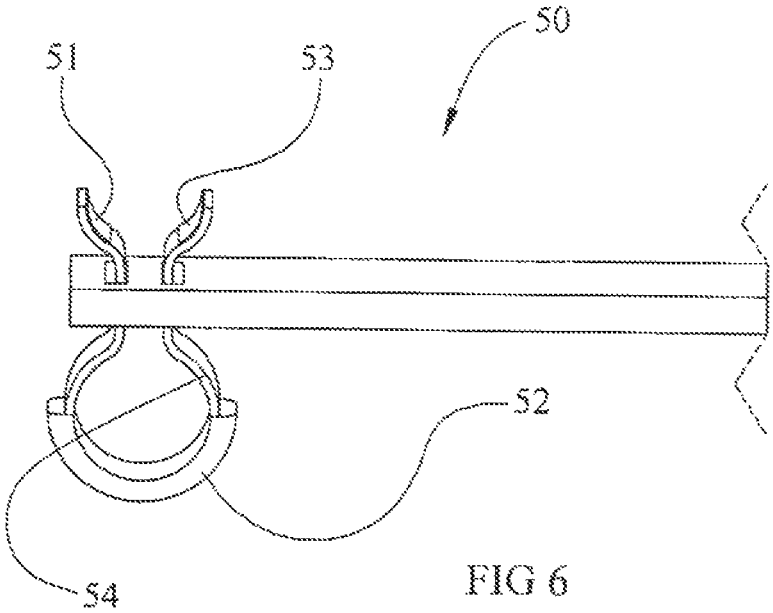
FIG. 6 is a partial top rear perspective view of a fifth embodiment of an intra-digital orthosis for use in shooting a ball such as a basketball according to the present invention.

Finally, as shown, in FIG. 6, various embodiments 50 of the invention may optionally employ finger receptacles having adjustable sizing straps 54 with hooks 51 and loops 53, and a spacer pad 52 (e.g., 4 mm (i.e., 0.16 inches) thick inclusive of the strap 54). Various other suitable sizing adjustment means could be used with this or other types of receptacles (e.g., for metallic finger receptacles, removable rubber gasket-type aperture inserts or the like).

In use, for the embodiments of FIGS. 1 and 3, the user inserts the tips of his index, middle, and ring fingers through the apertures of the three corresponding finger receptacles of the orthosis, until the receptacles are on those fingers' intermediate phalanges, e.g., about midway between the proximal-interphalangeal joints and distal-interphalangeal joints. The user then grasps the basketball, and is aided by the orthosis in position and action of the hand, especially during the act of shooting.

The embodiment of FIG. 5 is used essentially in the same fashion as the embodiments of FIGS. 1 and 3, except that it restrains the middle finger less, and may preferably be employed by a user who has already fundamentally learned to use an embodiment having a middle finger receptacle. By eliminating the obstruction against flexion of the middle finger, the embodiment of FIG. 5 permits the user to flex the middle finger further during release of the basketball so as to impart increased force from the middle finger.

By spacing apart the fingertips of the index, middle, and ring fingers, and/or encouraging flexion of the distal phalanges of at least the index and ring fingers, and/or facilitating an arch angle between those fingers and the middle finger that approximates the curvature of a basketball, an orthosis according to the present invention facilitates and enhances the user's ability to position the hand for shooting the basketball with backward rotation, touch, and accuracy. The applicant has also found that "muscle memory" can also be engrained through use of such an orthosis, resulting in improvement in shooting style after such use.

Figure 7:
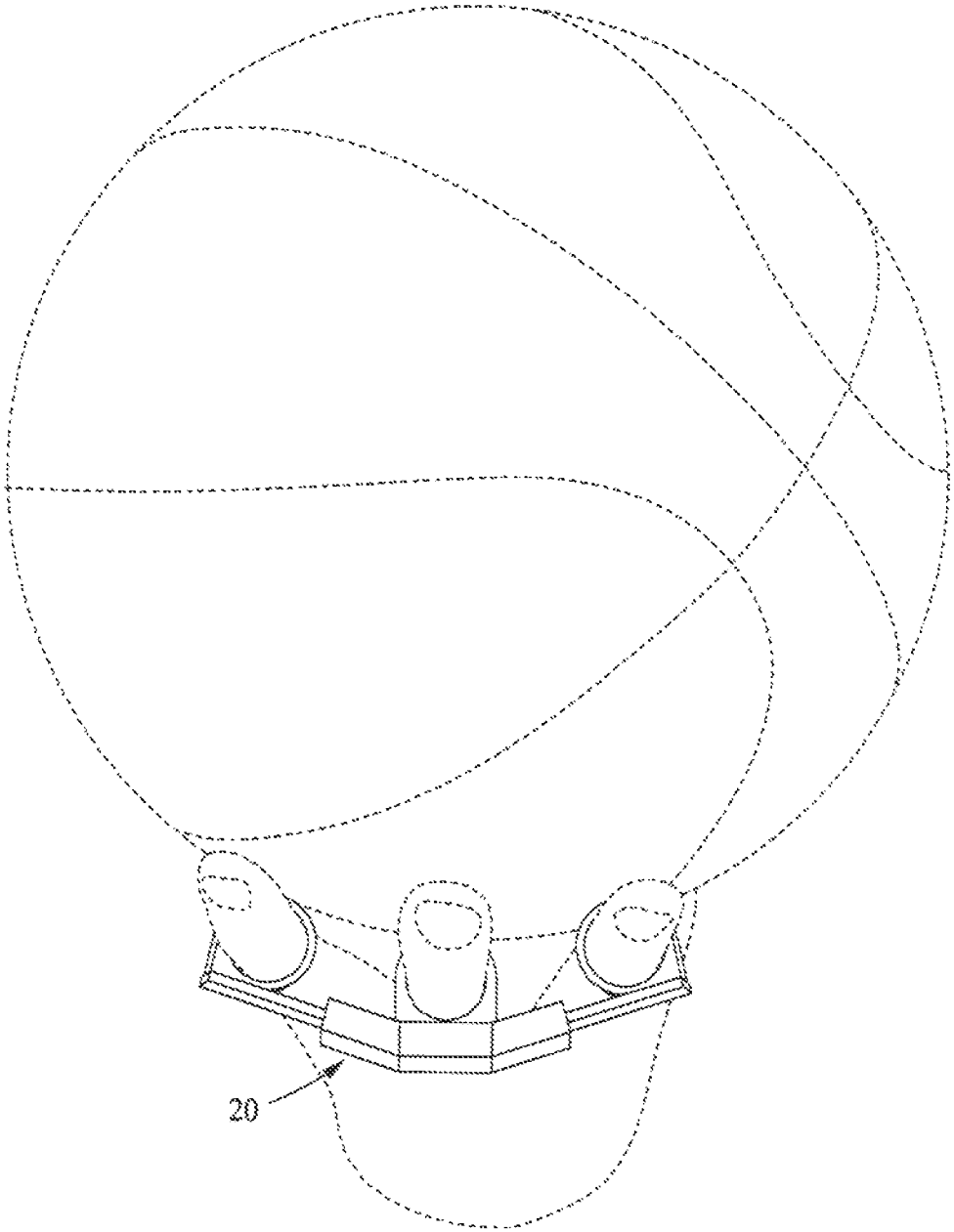
FIG. 7 shows the intra-digital orthosis of FIG. 3 in combination with a basketball for use during shooting the basketball.

To this end, FIG. 7 shows the orthosis 20 of FIG. 3 being used in combination with a basketball (shown in phantom lines), such that the user's index, middle and ring fingers are positioned in contact with the basketball when the user grasps the basketball during shooting in the manner previously described. In this same regard, any of the other orthoses shown in the drawings can also be used with a basketball in an identical fashion to that shown in FIG. 7.

Although the present invention has been described in detail in the context of a preferred embodiment of an orthosis for use in shooting a basketball, one skilled in the art will appreciate that numerous variations, modifications, and other applications are also within the scope of the present invention. For example, an intra-digital orthosis according to the present invention could also be adapted (for example, by adjusting the arch and/or spread angles) for use in shooting other similar shaped balls, such as a football. Further, embodiments of the present invention in which the arch angle and/or spread angle is adjustable will be readily apparent to one of ordinary skill in the art. Thus, the foregoing detailed description is not intended to limit the invention in any way, which is limited only by the following claims and their legal equivalents.

What is claimed is:

1. Apparatus for practicing shooting a basketball, comprising:

a basketball; and an intra-digital device to hold fingers of a user in contact with the basketball so as to enable the user to practice shooting the basketball, said device including:

a first linking member;

a second linking member, said first and second linking members having respective first ends that are joined to one another at a joint located between said first ends so that an angle greater than zero is established between said first and second linking members;

an index finger receptacle located at the opposite end of said first linking member and being sized to receive the index finger of the user;

a ring finger receptacle located at the opposite end of said second linking member and being sized to receive the ring finger of the user; and a middle finger receptacle connected to the joint at which the first ends of said first and second linking members are joined to one another and being sized to receive the middle finger of the user, said middle finger receptacle lying closer to said joint than to either one of said index and ring finger receptacles, said index, ring and middle finger receptacles positioned relative to one another so that said middle finger receptacle lies within a triangular space surrounded by the first and second linking members and an imaginary line extending between said index finger and ring finger receptacles, whereby the index, ring and middle fingers of the user when received through said index, ring and middle finger receptacles are held in contact with said basketball while practicing.

2. The apparatus recited in claim 1, wherein the joint at which the first ends of said first and second linking members of said intra-digital device are joined to one another to establish the angle between said first and second linking members is located on said middle finger receptacle.

3. The apparatus recited in claim 1, wherein none of the longitudinal axes through respective ones of said index finger, said ring finger and said middle finger receptacles of said intra-digital device are aligned parallel to one another.

4. Apparatus for practicing shooting a basketball, comprising:

a basketball; and an intra-digital device to hold fingers of a user in contact with the basketball so as to enable the user to practice shooting the basketball, said device including:

an index finger receptacle through which to receive the index finger of the user;

a ring finger receptacle through which to receive the ring finger of the user;

a middle finger receptacle through which to receive the middle finger of the user, said middle finger receptacle lying between said index finger receptacle and said ring finger receptacle;

a central member to which said middle finger receptacle is fixedly attached, a first linking member having a first end to which said index finger receptacle is attached and an opposite end slidably received by said central member so that the distance between said index finger receptacle and said middle finger receptacle is selectively adjustable, and a second linking member having a first end to which said ring finger receptacle is attached and an opposite end slidably received by said central member so that the distance between said ring finger receptacle and said middle finger receptacle is selectively adjustable, wherein said middle finger receptacle is located in a triangular space surrounded by said first linking member, said second linking member and an imaginary line between the centers of said index finger and ring finger receptacles, said index, ring and middle finger receptacles positioned relative to one another so that the index, ring and middle fingers of the user received therethrough are held in contact with said basketball while practicing.

5. Apparatus for practicing shooting a basketball, comprising:

a basketball; and an intra-digital device to hold fingers of a user in contact with the basketball so as to enable the user to practice shooting said basketball, said device including:

a linking member having first and second ends that are coupled to one another at a joint so that said first and second ends make an angle greater than zero, each of said first and second ends having at least one retaining hole formed therein;

an index finger receptacle through which to receive the index finger of the user, said index finger receptacle being detachably connected to the first end of said linking member;

a ring finger receptacle through which to receive the ring finger of the user, said ring finger receptacle being detachably connected to the second end of said linking member; and a middle finger receptacle through which to receive the middle finger of the user, said middle finger receptacle lying in a triangular space surrounded by the first and second ends of linking member and en imaginary line extending between the centers of said index finger and ring finger receptacles, said index, ring and middle finger receptacles positioned relative to one another so that the index, ring and middle fingers of the user received therethrough are held in contact with said basketball while practicing, and wherein each of said index and ring finger receptacles includes an adjustable locking strap, the adjustable locking straps of said index finger and ring finger receptacles being pushed into releasable receipt by respective ones of said retaining holes, whereby said index finger and ring finger receptacles are detachably connected to and removable from the first and second ends of said linking member.

* * * * *